United States Patent [19]

Carter

[11] Patent Number: 4,869,634

[45] Date of Patent: Sep. 26, 1989

[54] VEHICLE PARKING APPARATUS

[76] Inventor: Lee R. Carter, 3920 S.W. 30th St., Lot, C-41, Ocala, Fla. 32674

[21] Appl. No.: 173,874

[22] Filed: Mar. 28, 1988

[51] Int. Cl.[4] ..... E04H 6/12

[52] U.S. Cl. ..... 414/240; 414/264; 414/281; 414/286

[58] Field of Search ..... 414/233, 234, 239, 240, 414/264, 277, 278, 280, 786, 279, 281, 286

[56] References Cited

U.S. PATENT DOCUMENTS

| | | | |
|---|---|---|---|
| 1,584,212 | 5/1926 | Burrell | 414/240 |
| 2,658,632 | 11/1953 | Baume | 414/240 |
| 2,787,386 | 4/1957 | Peterson | 414/240 |
| 2,930,496 | 3/1960 | Wheeler | 414/240 |
| 2,936,082 | 5/1960 | Alimanestiano | 414/234 |
| 3,008,590 | 11/1961 | Alimanestiano | 414/240 |
| 3,857,500 | 12/1974 | Goldhofer | 414/240 |

*Primary Examiner*—David A. Bucci
*Attorney, Agent, or Firm*—Thomas & Kennedy

[57] ABSTRACT

A vehicle parking garage has a plurality of storage areas arranged in a vertical column and a passageway beside the column in communication with the storage areas. Each storage area has associated therewith a storage member adapted to receive and contain a pallet. Each storage member has a storage position within a storage area and a loading position within the passageway and is adapted to move laterally between its storage and loading positions. A pair of spaced vertical track sections are mounted to each storage member and extend partially into the passageway when the storage members are in their storage positions with the track sections of adjacent storage members aligning vertically to define a pair of vertically extending tracks within the passageway. Each pallet is adapted to move vertically within the passageway when its associated storage member is in its loading position and includes pairs of spaced track followers that couple with the vertically oriented tracks to maintain the pallet in a substantially fixed horizontal orientation within the passageway. A cable system selectively moves a storage member to its loading position, lowers its pallet to the bottom of the passageway for loading, raises the loaded pallet back into its storage member and moves the storage member back to its storage position for storage.

7 Claims, 5 Drawing Sheets

VEHICLE PARKING APPARATUS

FIELD OF THE INVENTION

The present invention relates to vehicle parking and particularly to an automated parking garage wherein vehicles are raised via cables to their storage positions.

BACKGROUND OF THE INVENTION

The shortage of parking space has become a major problem in modern metropolitan areas. The high cost of real estate in such areas has made it impractical to dedicate large areas of land to parking lots. In order to provide the maximum parking space for the minimum dedicated real estate, multi-story parking garages have been developed. Such parking garages generally comprise a plurality of parking decks or levels interconnected by ramps such that an individual can drive his vehicle up the ramps to successively higher decks until he locates an available parking space.

While multi-story parking decks have provided more parking space for a given area, they have not always proven convenient to the parking public. It is often necessary to drive to the upper levels of the garage in order to locate an available parking space an, after having parked to walk or take long flights of stairs back to the ground level. In addition to requiring valuable time, parking in these multi-deck garages can be extremely frustrating. Further, operation of such garages require the presence of at least one attendant at all times to collect money, operate toll gates and generally maintain the garage.

Accordingly, a need has been felt for a parking garage that provides parking for large numbers of vehicles in a small space and that does not require an individual to spend time driving to upper levels of a deck and walking down therefrom. Further, an automated garage not requiring the presence of an attendant is highly desirable to reduce the cost of operating the garage.

One example of an attempt to satisfy this need is illustrated in U.S. Pat. No. 3,511,389 of the present applicant. While the device disclosed in this patent eliminates the need to drive to successively more elevated parking levels, it still requires the presence of an operator skilled in its use. Further, the mechanical mechanism of this device is complex and bulky with the mechanism itself occupying space that could otherwise be dedicated to automobiles. As a consequence, devices such as those illustrated in the '389 patent have not proven to be optimum solutions to the problems discussed above.

Other attempts are embodied in parking garages known in the industry as Pigeon Hole, Minute Park, Speed Park and Bowser System. Each of these systems utilize a traveling crane elevator developed by M. E. Mitchell to move vehicles to various levels of a storage garage. These garages have not proven to be successful because of the extended times required to retrieve a vehicle. Several such systems have been built and abandoned.

Thus, it is to the provision of a parking garage that overcomes the problems of prior art garages that the present invention is primarily directed.

SUMMARY OF THE INVENTION

The present invention is a parking garage wherein vehicles are driven into the garage at ground level and subsequently raised via a cable system to a storage location in an elevated level of the garage. The garage generally comprises a framework structure defining a plurality of vertically oriented vehicle storage areas and a vertically extending passageway adjacent to and in communication with the storage areas. Each storage area has associated therewith a storage member or pallet arrester that is adapted to move horizontally from its storage area into the passageway. The pallet arresters contain vehicle bearing members or pallets that are adapted to be lowered through the passageway via an associated cable system from their respective pallet arresters to the ground level to receive or deliver a vehicle.

A pair of spaced vertically extending track sections is mounted to each pallet arrester such that they extend partially into the passageway The track sections align vertically when the pallet arresters are in their storage areas such that a continuous vertically extending track is defined in the passageway. Each pallet has a plurality of track followers adapted to couple with and follow the track as the pallet moves vertically within the passageway such that the pallet is maintained in a relatively fixed horizontal orientation as it is lowered and raised within the passageway.

A cable system is located adjacent the periphery of the structure and is adapted to move the pallet arresters into the passageway and to lower and raise the pallets within the passageway. The cable system occupies minimum space and does not require space that can be dedicated to vehicle storage.

In operation, a driver drives his car to the entrance of the garage which activates a switch causing a pallet arrester containing an empty pallet to move into the passageway and lower the pallet to the ground level. The driver then moves his vehicle onto the pallet and disembarks. The pallet containing the vehicle is then raised through the passageway into its pallet arrester and the pallet arrester is moved laterally into its storage area for storage.

Each pallet arrester has its own cable system for elevating vehicles as opposed to the single elevator or crane used in many prior art systems. Storage and retrieval of vehicles is consequently much faster than with these systems, eliminating the primary cause of their failure. Further, the garage of the present invention is fully automated and requires no attendant thus reducing its cost of operation significantly relative to prior art garages.

It is, therefore, an object of the invention to provide a parking garage for storing vehicles in vertical disposition relative to each other.

Another object of the invention is to provide a parking garage that eliminates the need to drive vehicles to successively more elevated levels.

Still another object of the invention is to provide a parking garage that is automated and does not require the services of an attendant.

A further object of the invention is to provide a parking garage wherein vehicles are raised vertically within a passageway and thence moved horizontally into a storage area.

Another object of the invention is to provide a parking garage wherein the operating mechanism does not occupy space that can be dedicated to vehicle storage.

Other objects, features and advantages of the invention will become apparent upon reading the following disclosure taken in conjunction with the accompanying drawings.

DETAILED DESCRIPTION

Figure 1:
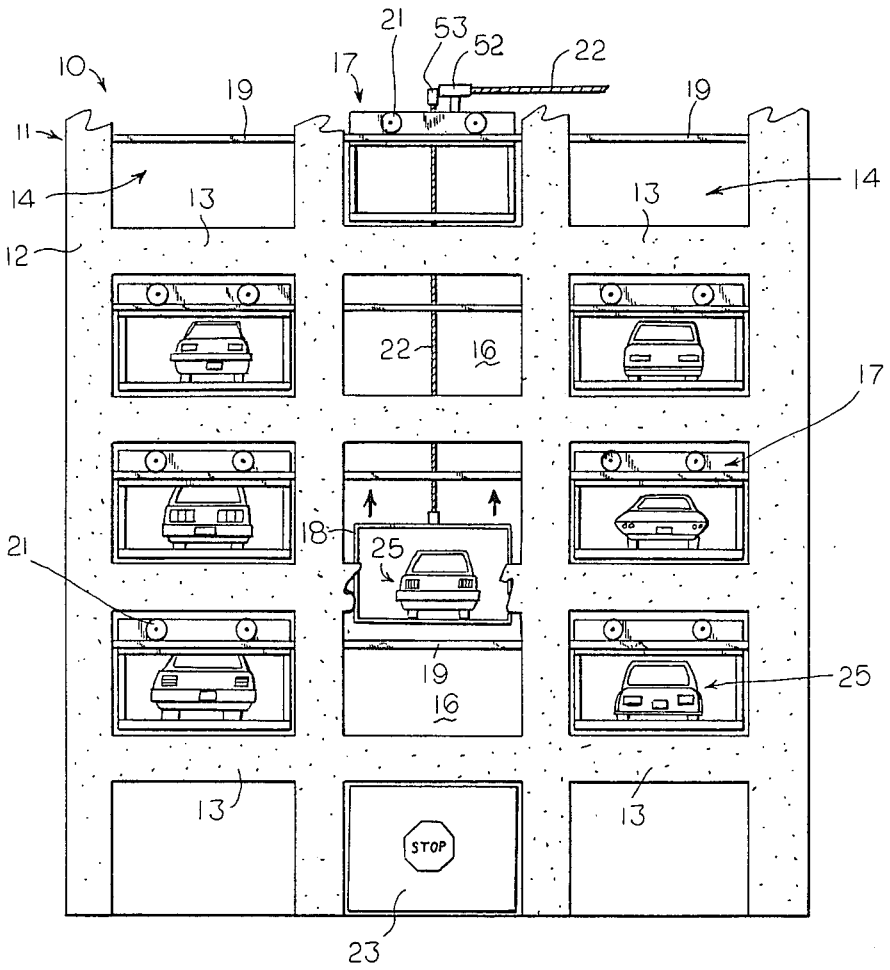
FIG. 1 is a front elevational view showing the principal components of the garage.

Referring now in more detail to the drawings in which like numerals represent like parts throughout the several views, FIG. 1 is a simplified elevational view of the parking garage showing its primary components and its general mode of operation. FIG. 1 shows the parking garage 10 having a rigid structure 11 comprising vertically extending sections 12 connected by horizontally extending sections 13. The rigid structure 11 defines a plurality of storage areas 14 arranged in two vertically oriented columns. The columns are separated by a vertical passageway 16 that is in communication with the storage areas 14.

Each storage area has associated therewith a storage member or pallet arrester 17 that is adapted to receive from the bottom thereof and contain a vehicle bearing member or pallet 18.

A plurality of pairs of spaced parallel rails 19 are firmly attached to the interior portion of the structure 11 and extend substantially horizontally from within the storage areas 14 into the vertical passageway 16. Each pallet arrester 17 has a pair of metal rollers 21 rotatably attached to each end and adapted to rest and roll upon the rails. With this arrangement, the pallet arresters are supported by the rollers upon the rails and are free to move along the rails between a storage area 14 and the vertical passageway 16.

Figure 6:
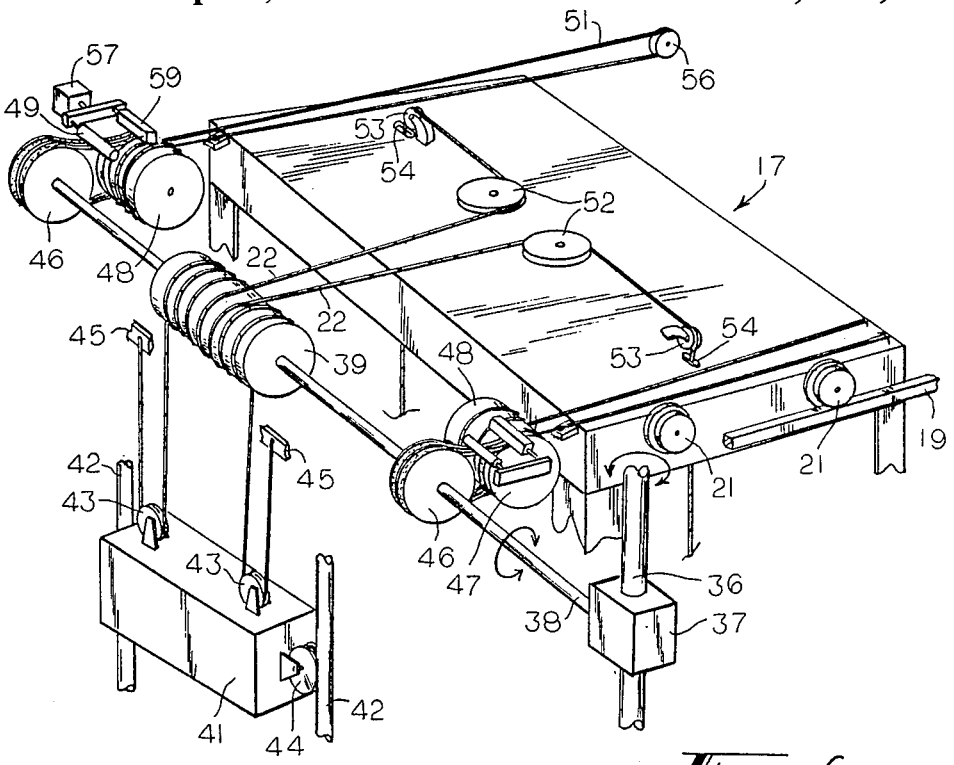
FIG. 6 is a perspective view showing the cable system used to move the storage containers and lower the vehicle bearing platforms.

Cables 22 are attached to each pallet 18 and extend upwardly through the pallet arrester 17, around sheaves 52 and 53 and thence laterally to the cable mechanism (FIG. 6). The cables in cooperation with the cable mechanism raise and lower the pallets 18 through the passageway 16 and into their associated pallet arresters 17 and move the pallet arresters laterally between the storage areas 14 and the passageway 16. The operation of the cable mechanism is discussed in more detail below.

Figure 2:
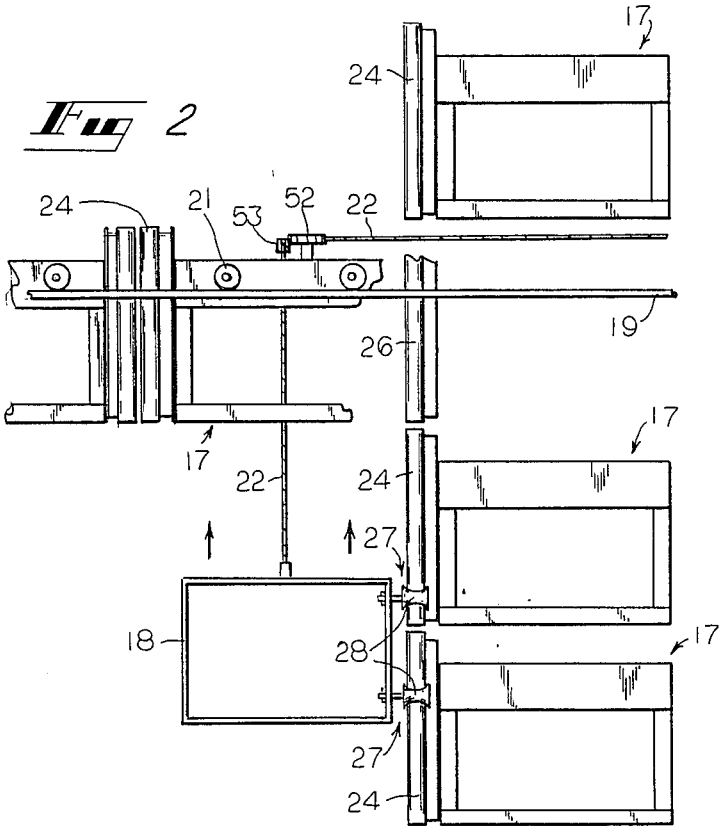
FIG. 2 is an elevational view partially in section showing the vertical tracks and the motion of a platform within the passageway.
Figure 3:
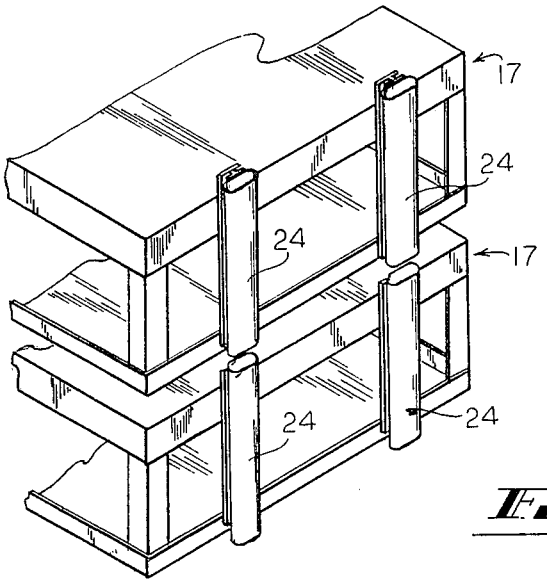
FIG. 3 is a perspective view, partially in section, showing the vertical alignment of track sections to form the vertically extending tracks.
Figure 4:
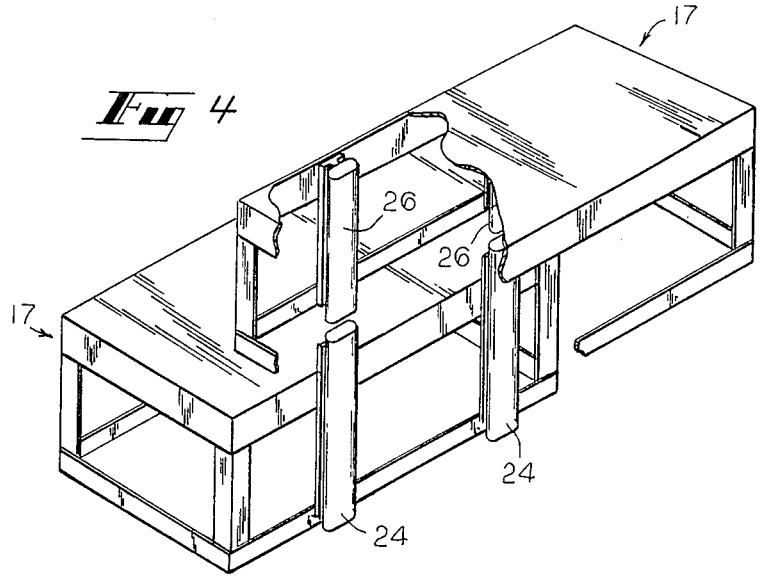
FIG. 4 is a perspective, partially in section, showing the alignment of the interior track sections with the vertical tracks when a storage compartment is in the passageway.

FIGS. 2–4 illustrate the vertically extending track system within the passageway that cooperates with the pallets to maintain them in substantially fixed horizontal orientation as they move vertically within the passageway. Each pallet arrester 17 has a pair of spaced parallel track sections 24 firmly attached thereto and extending partially into the passageway. As best shown in FIGS. 2 and 3, the track sections 24 are arranged to align vertically within the passageway when the pallet arresters 17 are in their respective storage areas 14. In this way, a pair of continuous vertically extending tracks are defined in the passageway by the aligned track sections.

Each pallet arrester 17 also has a pair of spaced track sections 26 attached to the interior portion thereof. The track sections 26 are adapted to align vertically with track sections 24 when a pallet arrester 17 is in the vertical passageway as best seen in FIGS. 2 and 4. Vertical track sections 26 cooperate with the pallets 18 to maintain the pallets in substantially fixed orientations within the pallet arresters 17 as discussed below.

Two pairs of track followers 27 are attached to each pallet 18 and are adapted to couple and cooperate with the vertically extending tracks formed by the track sections 24. The track followers of the preferred embodiment each comprise a pair of opposing follower wheels 28 having a generally concave circumference such that the track sections 24 extend between and are captured by the follower wheels 28 (see FIG. 5).

Track followers 27 cooperate with the vertically extending tracks as the pallet is raised and lowered within the passageway to maintain the pallet in a relatively fixed horizontal orientation. Further, as a pallet 18 moves upwardly into its pallet arrester 17 as shown in FIG. 2, the track followers move from the vertically extending tracks onto the aligned internal track sections 26 of its associated pallet arrester. Thus, the track followers not only cooperate with the vertically extending tracks within the passageway but also cooperate with the internal track sections 26 to maintain the pallet in its proper orientation within the pallet arrester.

Figure 5:
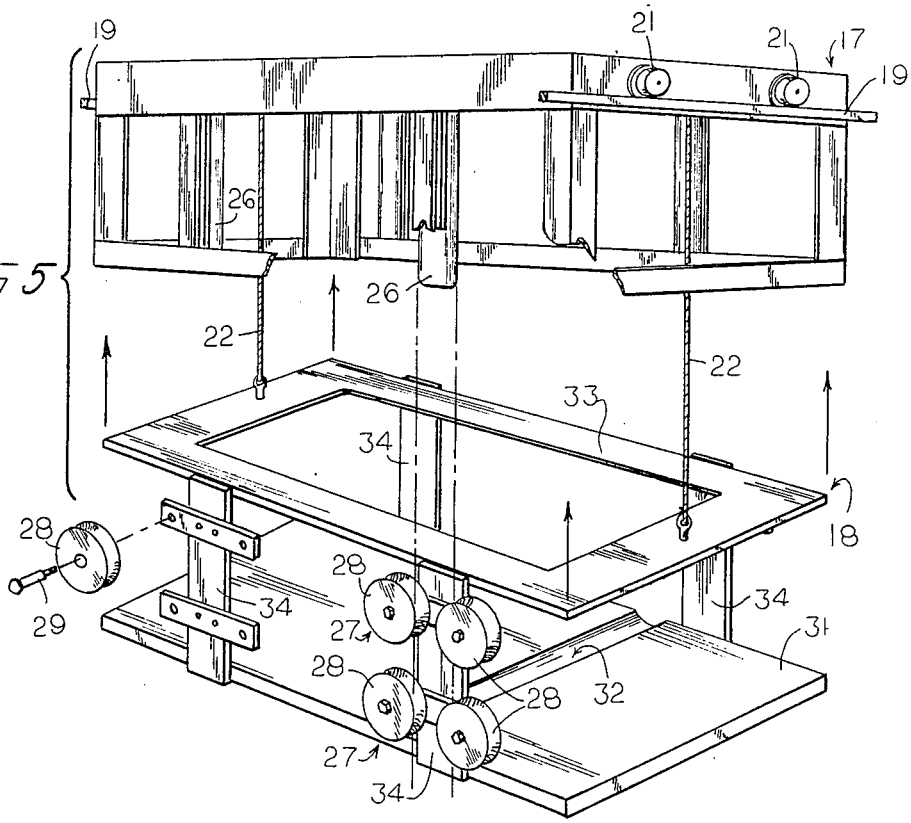
FIG. 5 is a perspective view, partially in section, showing a vehicle bearing platform being raised into a storage container.

FIG. 5 is a perspective view showing a pallet 18 moving into a pallet arrester 17. The pallet 18 has a pallet floor 31 in which is formed a transversely extending wheel depression 32. The wheel depression 32 acts to properly position a vehicle within a pallet when the vehicle wheels fall into the depression. A plurality of vertically extending staves 34 connect the pallet floor 31 to the pallet upper portion 33 that is in turn attached to cables 22. One pair of the staves 34 also supports the track followers 27 as seen in FIG. 5.

Also shown in FIG. 5 are laterally extending rails 19 and rollers 21 that cooperate to support the pallet arrester 17 within the structure 11 while facilitating its movement between the storage area and the passageway. Internal track sections 26 can also be seen in FIG. 5.

FIGS. 6–9 illustrate the cable system and drive mechanism used to move the pallet arresters into the passageway and to lower the pallets to the ground level for loading and unloading. FIG. 6 shows a pallet arrester 17 supported on rails 19 by rollers 21. A pair of openings 54 are formed in the top of the pallet arrester and cables 22 extend through the openings downwardly to the pallet (not shown) to which they are attached as shown in FIG. 5. Each cable 22 extends upwardly from the pallet through opening 54, around vertical sheave 53 and thence around lateral sheave 52. From lateral sheave 52, each cable 22 extends generally horizontally across the top of the pallet arrester 17 to a worm drum 39 around which it extends at least one revolution.

From the worm drum 39, each cable 22 extends downwardly and around a counter weight sheave 43, thence upwardly where it is attached to a fixed portion 45 of the structure 11. The counter weight sheaves 43 are attached to a counter weight 41 that is adapted to move vertically by virtue of counter weight tracks 42 and counter weight track followers 44 as seen in FIG. 6.

A jack shaft 38 is firmly attached to the worm drum 39 and extends through the longitudinal center thereof. The jack shaft 38 is coupled at one end to a vertically extending drive shaft 36 through differential mechanism 37. The drive shaft 36 is driven by a motor 63 (FIG. 7) and each differential 37 is adapted to be individually and separately activated such that only the jack shaft 38 corresponding to the activated differential 37 is driven by the drive shaft 36.

A pair of drive sheaves 46 are attached to the jack shaft 38 on either side of the worm drum 39 and are coupled through belts 50 to idler sheaves 47. Idler drums 48 are mounted to idler sheaves 47 and are coaxial therewith such that rotation of the idler sheaves causes the idler drums to rotate accordingly. A pair of cables 51 extend from the idler drums generally horizontally to and around fixed sheaves 56 and thence back to a fixed point on the pallet arrester 17, and back to idler sheave 48 forming an "endless cable" as seen in FIG. 6. It should be noted that the diameters of the idler drums and the worm drum are substantially identical in the preferred embodiment.

Figure 9:
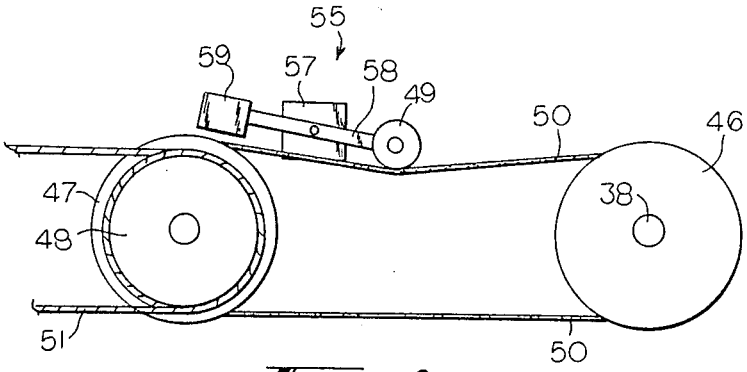
FIG. 9 is a side elevation of the mechanism of FIG. 8.

Clutch assembly 55 comprises clutch roller 49 and idler sheave brake member 59 extending laterally from distal ends of clutch rocker arm 58. Rocker arm 58 is in turn coupled through pivot rod 60 to clutch solenoid 57 which is adapted to be activated by clutch switch 62. As best seen in FIG. 9, in one position of clutch solenoid 57, clutch roller 49 is forced against belts 50 causing them to tighten which in turn causes idler sheave 47 and idler drum 48 to be rotated by drive sheave 46, letting out or taking up cable 51. In a second position of clutch solenoid 57, idler sheave brake 59 is forced into contact with idler sheave 47 and clutch roller 49 is raised from the belts 50. In this configuration, the idler sheave 47 and idler drum 48 are maintained firmly in their positions and do not rotate in response to rotation of the drive pulley 46.

Figure 7:
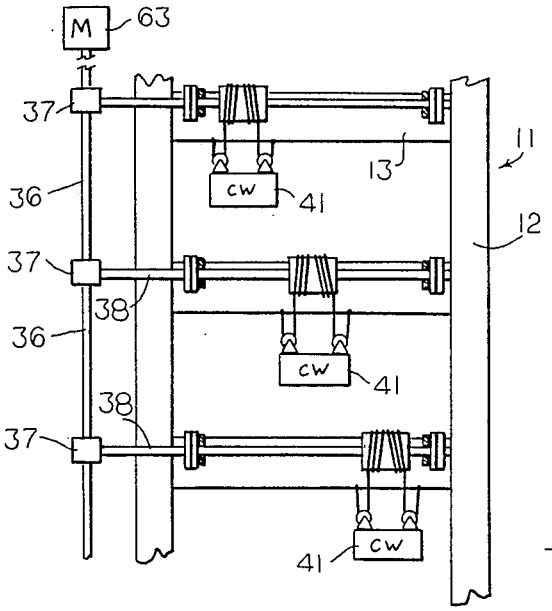
FIG. 7 is a side elevation showing the orientation of the counter weights.
Figure 8:
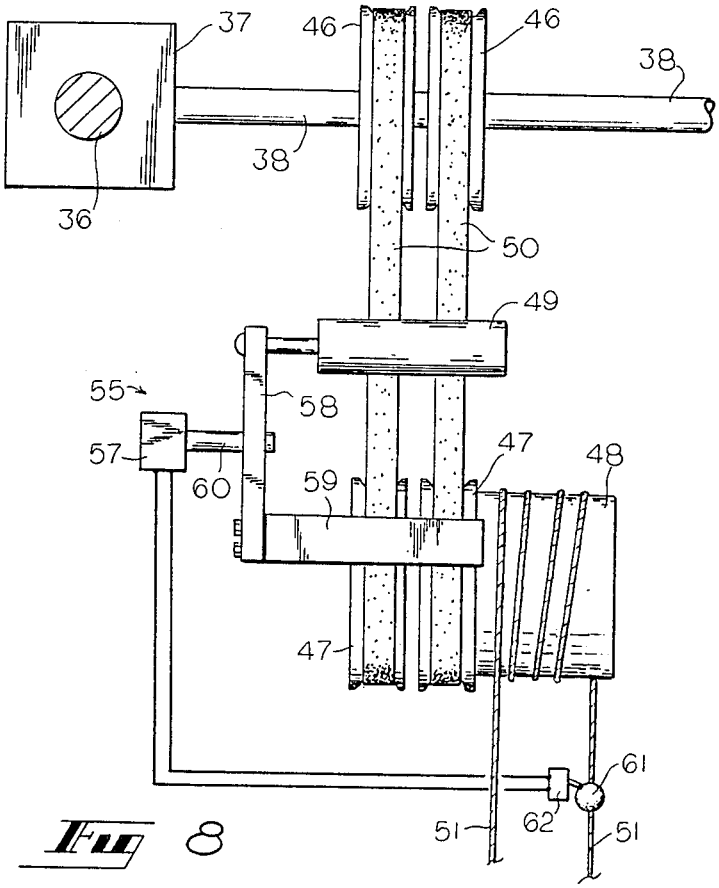
FIG. 8 is a plan view of the mechanism for moving the storage containers horizontally into the passageway.

As seen in FIG. 7, successive worm drums 39 and counter weights 41 are staggered laterally relative to each other to allow the counter weights a greater vertical distance in which to move.

OPERATION

When parking a vehicle in the garage of the present invention a motorist drives his vehicle to the entrance 23 of the garage where a switch (not shown) embedded in the pavement detects the presence of the vehicle. In response to the detection, the differential 37 corresponding to an available pallet arrester is engaged and reversible motor 63 is activated causing drive shaft 36 to turn in a first direction. Simultaneously, the clutch solenoid 57 is activated causing the clutch roller 49 to engage the belts 50 coupling the drive sheave 46 with the idler sheave 47. The rotation of the drive shaft 36 is transferred through the differential 37 to the jack shaft 38 causing it to rotate. As the jack shaft rotates in a clockwise direction as viewed in FIG. 6, the worm drum 39, drive sheaves 46, idler sheaves 47 and idler drums 48 are also caused to rotate in a clockwise direction.

The worm drum 39 and idler drums 48 have equal diameters and cables 22 and 51 are wrapped around their respective drums in opposite directions. With this configuration, rotation of the drums in a clockwise direction in FIG. 6 causes cables 22 to be let out from the worm drum 39 toward the pallet arrester 17 and causes cables 51 to pull the pallet arrester 17 from its storage area into the vertical passageway. Because the worm drums and idler drums have the same diameter, the pallet arrester moves laterally at the same rate that the cables 22 are being let out from the rotating worm drum 39 preventing slack in the cables 22.

When the pallet arrester 17 is moved completely into the passageway, it contacts a switch (not shown) that activates the clutch solenoid 57 disengaging the clutch roller 49 and engaging the idler sheave brake 59. This prevents further movement of cables 51 maintaining pallet arrester 17 in a fixed position within the passageway.

As jack shaft 48 continues to rotate, cables 22 continue to be let out by rotating worm drum 39. Because the pallet arrester 17 is no longer moving, the cables 22 extending around sheaves 52 and 54 lower the pallet 18 through the passageway to the ground level. The counter weight 41 is consequently raised helping to offset the weight of the pallet 18. When the pallet 18 reaches the ground level, the door 23 is caused to open and the driver moves his car onto the pallet until his front tires fall into the wheel depression 32.

When his vehicle is in place on the pallet, the driver turns off his vehicle and disembarks. As he leaves the garage, he removes a key from a position on a panel (not shown) corresponding to the pallet 18 on which his vehicle is parked. As he takes the key, the reversible motor 63 is activated in the opposite direction causing the jack shaft 38 and worm drum 39 to rotate in a counter clockwise direction as viewed in FIG. 6 raising the pallet and the vehicle upwardly through the passageway and into the pallet arrester 17. When the pallet 18 has been received in the pallet arrester, it contacts a switch (not shown) that activates the clutch solenoid 57 engaging the idler sheave and idler drum.

Continued rotation of the jack shaft rotates the idler drums 48 pulling the attached pallet arrester back into its storage area. Once in place in the storage area, switch activator 61 (FIG. 8) activates switch 62 disengaging roller 49 and engaging brake 59. Differential 37 is simultaneously disengaged and motor 63 is stopped completing the parking cycle.

To reclaim his car, the driver simply inserts the key into the proper location on the panel (not shown) which activates the motor and differential lowering his car to ground level where he can drive it out of the structure.

While many electronic control circuits are available, a preferred method of controlling the just described operation is through an appropriately programmed computer interfaced to the key panel and to the cable system.

The invention has been described in terms of a preferred embodiment. It will be understood by those of skill in the art that many modifications and additions can be made to the preferred embodiment without departing from the spirit and scope of the invention as set forth in the claims. In addition, the invention has been described in the context of a garage for parking cars. The same inventive concepts can be applied to various other article storage requirements such as boat dry dock storage, merchandise storage or personal storage rental space.

What is claimed is:

1. A vehicle parking apparatus comprising:

means defining a plurality of vehicle storage areas arranged in at least one vertically oriented column, and a vertical passageway adjacent aid column in communication with said storage areas;

a plurality of storage members with each storage member having a first position within one of said storage areas and a second position within said passageway adjacent its storage area and being adapted to move between said first and second positions;

a plurality of vehicle bearing members each adapted to be received into a corresponding storage member;

each of said vehicle bearing members being further adapted to move vertically within said passageway and having a loading position adjacent a bottom of the passageway and a storage position within its corresponding storage member;

first means for moving said storage members between their first positions and their second positions;

second means for moving each of said vehicle bearing members between its storage position and its loading position when its corresponding storage member is in said second position;

guide means for maintaining each vehicle bearing member in a substantially fixed horizontal orientation as its moves within said vertical passageway, said guide means comprising a pair of spaced parallel vertically oriented tracks within said passageway adjacent said column and a pair of track followers mounted to each of said vehicle bearing members arranged to cooperatively engage said tracks as said bearing member moves within said passageway;

said tracks being defined by a plurality of pairs of spaced parallel track sections mounted to a side of each storage member adjacent said passageway with the track sections of one storage member being arranged to align vertically with track sections of adjacent storage members when the storage members are in their first positions within said storage areas.

2. The apparatus of claim 1 wherein each storage member further includes means for maintaining its associated vehicle bearing member in a substantially fixed orientation in its storage position within said storage member, said means comprising a pair of spaced parallel track sections mounted to a side of said storage member on the interior thereof, said interior track sections being arranged to align vertically with said spaced parallel tracks when the storage member is in its second position within the passageway, whereby said track followers move from said tracks onto said interior track sections as said vehicle bearing member moves into its storage position within the storage member.

3. A vehicle parking apparatus comprising:

means defining a plurality of vehicle storage areas arranged in at least one vertically oriented column, and a vertical passageway adjacent said column in communication with said storage areas;

at least one storage member having a first position within one of said storage areas and a second position within said passageway adjacent its storage area and being adapted to move between said first and second positions a vehicle bearing member adapted to be received into said storage member;

said vehicle bearing member being further adapted to move vertically within said passageway and having a loading position adjacent a bottom of the passageway and a storage position within said storage member;

first means for moving said storage member between its first position and its second position;

second means for moving said vehicle bearing member between its storage position and its loading position while said storage member is in its second position;

means for supporting said storage member while permitting movement between its first and second positions, said means comprising a pair of spaced rails mounted to said storage area defining means and extending substantially horizontally from within said storage area into said passageway, and two opposing pairs of spaced apart rollers rotatably attached to said storage member and adapted to align with and rest upon said rails;

said second means comprising;

a jack shaft;

means for rotating said jack shaft;

a substantially cylindrical worm drum firmly attached to said jack shaft with said jack shaft extending through a longitudinal center of the worm drum;

a counterweight having a pair of sheaves attached thereto; and a pair of cables with each cable being firmly attached at one end to a fixed portion of said defining means and extending downwardly therefrom, around one of said sheaves thence upwardly and around said worm drum at least one revolution, said cables further extending through said storage member and being firmly attached to said vehicle bearing member, whereby the vehicle bearing member is lowered and the counterweight raised by the cables as the jack shaft rotates in one direction and the vehicle bearing member is raised and the counterweight lowered as the jack shaft rotates in an opposite direction.

4. An apparatus for storing articles comprising:

a structure defining a plurality of vertically arranged storage areas and a vertical passageway adjacent to and in communication with said storage areas;

a plurality of storage members normally positioned within said storage areas and being adapted to move from the storage areas into the passageway;

a plurality of article bearing members each having a storage position within a storage member and a loading position adjacent a bottom of said passageway and being adapted to move between said storage position and said loading position while said storage member is within said passageway;

means for moving said storage members between said storage areas and said passageway;

means for moving said article bearing members between their storage positions and their loading positions;

track means within said passageway for maintaining said article bearing members in a substantially fixed horizontal orientation as they move between said storage and said loading positions;

said track means comprising a pair of spaced vertically oriented tracks within said passageway adjacent said storage areas and a plurality of track followers mounted to each article bearing member with said track followers being adapted to couple with said tracks as said article bearing members move within said passageway between their storage and loading positions;

said vertically oriented tracks being defined by a plurality of spaced track sections attached to said storage members, said track sections being arranged to align vertically within said passageway when said storage members are within said storage areas.

5. A parking garage comprising:

a rigid structure defining a plurality of vertically oriented storage areas and a vertical passageway adjacent to and in communication with said storage areas;

a plurality of pallet arresters normally positioned within said storage areas and adapted to move from said storage areas into said passageway;

a plurality of pallets with each pallet having a storage position within a pallet arrester and a loading position adjacent a the bottom of said passageway, said pallets being adapted to move within said passageway between said loading and said storage positions;

means for supporting said pallet arresters within said structure while facilitating their movement between the storage areas and the passageway, said means comprising a plurality of pairs of spaced parallel rails mounted to said structure and extending from said storage areas into said passageways and roller means attached to said pallet arresters and adapted to rest on and roll along said rails;

means for maintaining said pallets in a substantially fixed horizontal orientation as they move within said passageway, said means comprising a pair of spaced parallel vertically extending tracks within said passageway adjacent said storage areas and a plurality of track followers mounted to each pallet and adapted to couple with said tracks, said tracks being defined by a plurality of track sections mounted to said pallet arresters with said track sections being arranged to align vertically within said passageway when said pallet arresters are in their storage locations;

means for maintaining said pallets in a substantially fixed orientation in their storage positions within said pallet arresters, said means comprising a pair of spaced parallel track sections mounted to an interior portion of each pallet arrester and arranged to align vertically with said vertically extending tracks when said pallet arrester is within said passageway whereby said track followers move from said vertically extending tracks onto said interior track sections as said pallet moves into its storage position within said pallet arrester;

means for moving said pallet arresters between said storage areas and said passageway; and means for moving said pallets within said passageway between said storage positions and said loading positions.

6. In an apparatus for storing articles of the type having a structure which defines a plurality of vertically arranged storage areas and a vertical passageway adjacent to and in communication with the storage areas, a plurality of storage members normally positioned within the storage areas and being movable from their respective storage areas into the vertical passageway, a plurality of bearing members each having a storage position within one of the storage members and a loading position adjacent a bottom of the passageway with each bearing member being movable through the passageway between its storage and loading positions and being maintained in a substantially fixed horizontal orientation as they move within the passageway by a pair of spaced tracks positioned within the passageway and corresponding track followers mounted to the bearing members, the improvement thereof wherein said tracks are defined by a plurality of spaced track sections attached to said storage members with said track sections being arranged to align vertically within said passageway when said storage members are positioned within said storage areas.

7. The improvement of claim 6 further comprising an additional pair of spaced track sections mounted to a portion of each of said storage members with said additional track sections being arranged to align vertically with the track sections of adjacent normally positioned storage members when said storage member is positioned within the passageway.

* * * * *